United States Patent [19]

Nakajima

[11] Patent Number: 4,602,561

[45] Date of Patent: Jul. 29, 1986

[54] DRIVING MECHANISM FOR A TYPE DRUM IN A PRINTER

[75] Inventor: Yoshiyuki Nakajima, Tanashi, Japan

[73] Assignee: Citizen Watch Co., Ltd., Tokyo, Japan

[21] Appl. No.: 704,426

[22] Filed: Feb. 22, 1985

[30] Foreign Application Priority Data

Feb. 24, 1984 [JP] Japan ..... 59-32295

[51] Int. Cl.[4] ..... B41J 9/10

[52] U.S. Cl. ..... 101/93.28; 74/411; 101/93.33; 101/93.34; 101/109

[58] Field of Search ..... 101/93.09, 93.18, 93.21, 101/93.28, 93.33, 93.34, 95, 106, 110, 109, 183; 74/411

[56] References Cited

U.S. PATENT DOCUMENTS

| | | | |
|---|---|---|---|
| 2,513,217 | 6/1950 | Tomlines | 74/411 X |
| 3,180,168 | 4/1965 | Harris | 74/411 X |
| 3,218,966 | 11/1965 | Petit | 101/95 |
| 4,104,967 | 8/1978 | Okabe | 101/95 X |
| 4,336,752 | 6/1982 | Asakura et al. | 101/95 X |

FOREIGN PATENT DOCUMENTS

| | | | |
|---|---|---|---|
| 235422 | 1/1969 | U.S.S.R. | 101/95 |

*Primary Examiner*—Edgar S. Burr
*Assistant Examiner*—Moshe I. Cohen
*Attorney, Agent, or Firm*—Birch, Stewart, Kolasch & Birch

[57] ABSTRACT

An impact printer has a type drum, a plurality of hammers, a type drum gear secured to a shaft of the type drum, and a gear train including a drive gear and an intermediate gear engaged with the drive gear and type drum gear for driving the type drum. A lever is provided to rotate about a shaft of the drive gear. The intermediate gear is rotatably supported on the lever at one end thereof, and a spring is provided for urging the lever in the direction that the intermediate gear engages with the type drum gear. The rotational direction of the type drum gear is such that the rotation of the type drum gear causes the intermediate gear to revolve around the drive gear to brake the type drum.

4 Claims, 4 Drawing Figures

DRIVING MECHANISM FOR A TYPE DRUM IN A PRINTER

BACKGROUND OF THE INVENTION

The present invention relates to a driving mechanism for a type drum in an impact printer.

FIG. 1 shows a conventional driving mechanism for a type drum in an impact printer. A type drum 10 has a plurality of type characters circumferentially arranged for each column and is secured to a type drum shaft 11 which is rotatably supported in side plates 12 and 13. A plurality of hammers 15 are disposed adjacent the type drum 10 arranged in the axial direction thereof in the well known manner. A type drum gear 14 is secured to the type drum shaft 11 at the outside of the plate 12. A first drive gear 18 driven by a motor (not shown) is engaged with a second drive gear 20 which is rotatably mounted on a shaft 22 secured to the plate 12. The gear 20 is engaged with the type drum gear 14 through an intermediate gear 21 which is rotatably mounted on a shaft 23 secured to the plate 12.

Thus, when the gear 20 is rotated in the direction of an arrow A, the type drum gear 14 is rotated in the direction of an arrow B through the intermediate gear 21 to rotate the type drum 10. During the rotation of the type drum 10, hammers 15 strike the type character to print the type on a paper 16 at a proper timing.

In such a printer, when all hammers 15 strike the type characters on the type drum 10 at the same time, the striking force of the hammers 15 operate as a brake against the type drum, which may cause the type drum 10 to stop or slow down. On the other hand, the gear 20 continues rotating so that small elastic deformation occurs in the gear train comprising gears 18, 20, 21 and 14. Immediately after that, hammers 15 are retracted to release the drum. Accordingly, the type drum 10 is rotated in the direction of the arrow B at a higher speed than the rated speed by the returning of the deformation. However, when the type drum 10 rotates an angle corresponding to the sum of backlashes in the gear train, the drum is stopped by the rotary shaft of the motor which rotates at a constant speed. The type drum bounds back and the movement repeats. Accordingly, the type drum 10 pulsates, rendering printed letters out of alignment which means decrease of the quality of printing.

SUMMARY OF THE INVENTION

The object of the present invention is to provide a driving mechanism for a type drum of a printer which may prevent the pulsation of the type drum.

According to the present invention, there is provided a driving mechanism for an impact printer of the type having side plates, a type drum rotatably supported on the side plates, a type drum gear secured to a shaft of the type drum, and a gear train including a drive gear and an intermediate gear engaged with the drive gear and type drum gear for driving the type drum. A lever is provided to rotate about a shaft of the drive gear, and the intermediate gear is rotatably supported on the lever at one end thereof. A spring is provided for urging the lever in the direction that the intermediate gear engages with the type drum gear, the rotational direction of the type drum gear is such that the rotation of the type drum gear causes the intermediate gear to revolve around the drive gear to increase engagement force exerted on the type drum gear.

In an aspect of the present invention, the shaft of the drive gear is secured to the side plate and the drive gear and the lever are rotatably mounted on the shaft.

These and other objects and features of the present invention will become more apparent from the following description with reference to the accompanying drawings.

DESCRIPTION OF THE PREFERRED EMBODIMENTS

Figure 1:
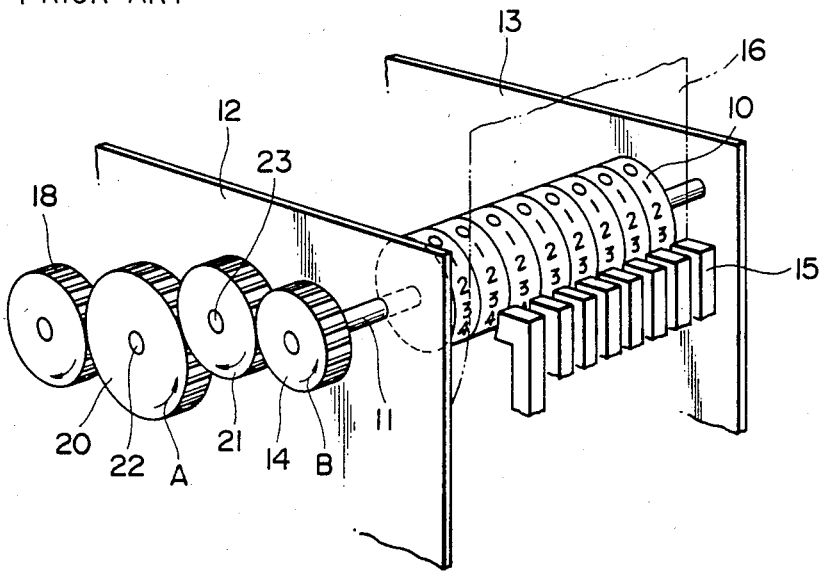
FIG. 1 PRIOR ART
FIG. 1 is a schematic perspective view showing a conventional driving mechanism for a type drum.
Figure 2:
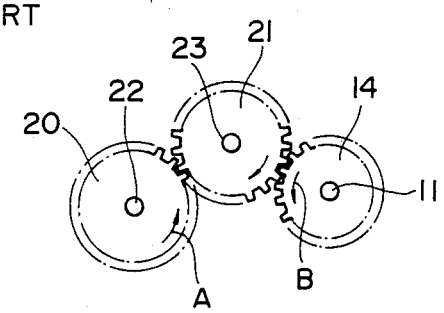
FIG. 2 PRIOR ART
FIG. 2 is a side view showing a part of a gear train of FIG. 1.
Figure 3:
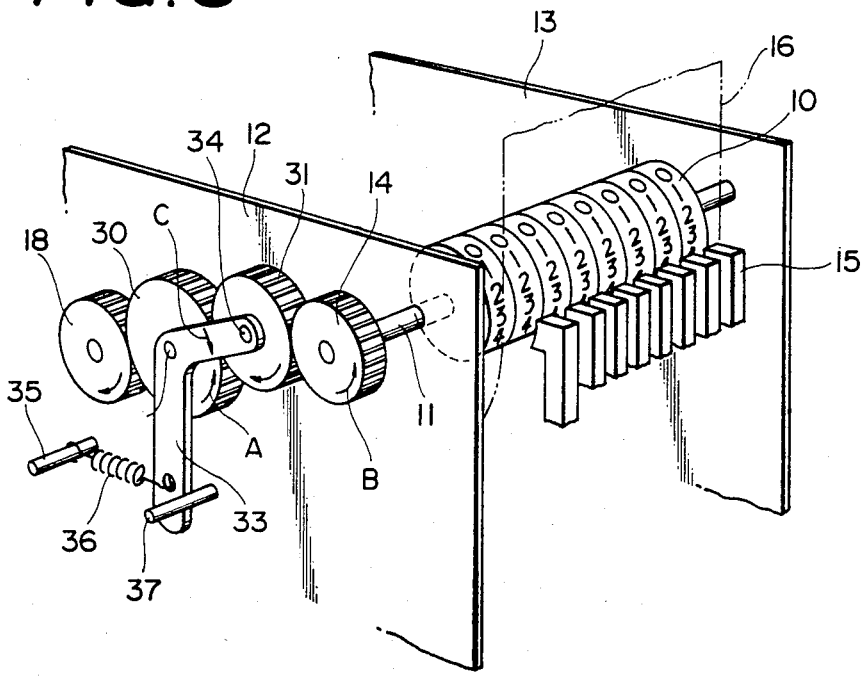
FIG. 3 is a schematic perspective view showing a driving mechanism for a type drum according to the present invention.
Figure 4:
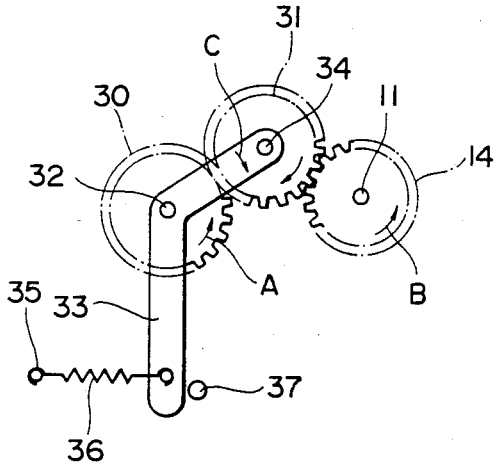
FIG. 4 is a side view showing a part of a gear train of the present invention.

Referring to FIGS. 3 and 4 showing a driving mechanism for a type drum according to the present invention, the same parts as the structure of the conventional structure are identified with the same reference numerals of those of FIGS. 1 and 2.

A second drive gear 30 engaged with the first drive gear 18 is rotatably mounted on a shaft 32 secured to the side plate 12. The gear 30 is engaged with an intermediate gear 31, which is in turn engaged with the type drum gear 14. The intermediate gear 31 is rotatably mounted on a shaft 34 which is secured to an end of an L-shaped swing lever 33. The swing lever 33 is rotatably supported on the shaft 32. A spring 36 is connected between the other end portion of the lever 33 and a pin 35 secured to the side plate 12 to urge the swing lever 33 in the clockwise direction C so as to engage the gear 31 with gear 14. A stopper 37 secured to the side plate 12 is disposed adjacent the swing lever 33 at the opposite side of the swing lever 33 to maintain the engagement of the gear 31.

In operation, as hereinbefore described, the type drum 10 is braked by hammers 15 and rotated in the direction of the arrow B higher than the ordinary speed when the hammers are retracted from the drum. At that time, the rotating force of the type drum 10 causes the swing lever 33 to rotate in the direction of an arrow C about the shaft 32. That is, the intermediate gear 31 revolves around the gear 30 to forcibly engage with the type drum gear 14 so that the type drum 10 is braked by the engagement to stop rapid rotation. Accordingly, the type drum 10 is prevented from pulsating. In addition, since the intermediate gear 31 is biased to engage with gears 14 and 30 by the spring 36, backlashes between type drum gear 14, intermediate gear 31, and gear 30 are decreased, so that pulsation can be more effectively prevented.

In accordance with the present invention, since the intermediate gear is urged by the spring to engage with the type drum gear and is revolved around the drive gear by the type drum gear, the intermediate gear operates to brake the type drum. Therefore, the pulsation of the type drum can be prevented, whereby the printing quality is improved.

While the invention has been described in conjunction with preferred specific embodiments thereof, it will be understood that this description is intended to illustrate and not limit the scope of the invention, which is defined by the following claims.

What is claimed is:

1. An improved driving mechanism for an impact printer of the type having side plates, a type drum rotatably supported on a shaft journaled on the side plates, hammers for selectively impacting said type drum a type drum gear secured to said shaft of the type drum, and a gear train including a drive gear and an intermediate gear engaged with the drive gear and type drum gear for driving the type drum, wherein the improvement comprises:

means for increasing the engagement force between the intermediate gear and the type drum gear responsive to an increase in the power required to drive the type drum such as when plural hammers are actuated, said means including:

a lever provided to rotate about said shaft of the drive gear;

the intermediate gear being rotatably supported on the lever at one end thereof; and a spring for urging the lever in the direction so that the intermediate gear engages with the type drum gear, the rotational direction of the type drum gear being such that the rotation of the type drum gear causes the intermediate gear to revolve around the drive gear to increase engagement force exerted on the type drum gear when the force required to drive the type drum increases.

2. The driving mechanism according to claim 1 wherein the drive gear and the lever are rotatably mounted on the shaft of the drive gear.

3. The driving mechanism according to claim 1 wherein the lever has an L-shape.

4. The driving mechanism according to claim 1 further comprising a stopper provided adjacent to the lever for maintaining the engagement of the intermediate gear with the type drum gear.

* * * * *